US009434490B2

(12) United States Patent
Magri et al.

(10) Patent No.: US 9,434,490 B2
(45) Date of Patent: Sep. 6, 2016

(54) WINDING MACHINE FOR GROUPS OF PACKAGES

(71) Applicant: A.C.M.I.—SOCIETA' PER AZIONI, Fornovo di Taro (Parma) (IT)

(72) Inventors: Giacomo Magri, Parma (IT); Giorgio Oppici, Parma (IT)

(73) Assignee: A.C.M.I.-SOCIETA'PER AZIONI, Fornovo di Taro (Parma) (IT)

( * ) Notice: Subject to any disclaimer, the term of this patent is extended or adjusted under 35 U.S.C. 154(b) by 671 days.

(21) Appl. No.: 13/855,185

(22) Filed: Apr. 2, 2013

(65) Prior Publication Data

US 2013/0255186 A1 Oct. 3, 2013

(30) Foreign Application Priority Data

Apr. 3, 2012 (IT) ..... RE2012A0023

(51) Int. Cl.
*B65B 11/02* (2006.01)
*B65B 13/12* (2006.01)

(52) U.S. Cl.
CPC ..... *B65B 11/025* (2013.01); *B65B 13/12* (2013.01); *B65B 2210/18* (2013.01)

(58) Field of Classification Search
None
See application file for complete search history.

(56) References Cited

U.S. PATENT DOCUMENTS 4,756,143 A 7/1988 Lancaster
5,768,862 A * 6/1998 Mauro ..... B65B 11/025 53/556
5,850,726 A * 12/1998 Degrasse ..... B65B 11/025 100/27
6,594,970 B1 7/2003 Hyne et al.
2006/0213155 A1* 9/2006 Forni ..... B65B 11/025 53/588
2008/0229714 A1* 9/2008 Zitella ..... B65B 11/025 53/449

FOREIGN PATENT DOCUMENTS

DE 10049298 A1 4/2002
EP 1816074 A1 8/2007
WO 2008115868 A1 9/2008

OTHER PUBLICATIONS

Search report from Italian priority application dated Dec. 20, 2012.

* cited by examiner

*Primary Examiner* — Hemant M Desai
*Assistant Examiner* — Tanzim Imam
(74) *Attorney, Agent, or Firm* — Browdy and Neimark, PLLC

(57) ABSTRACT

A machine for winding a load by an extensible web, including a fixed base for supporting the load, a fixed framework overlying said base, a framework moveable vertically on the fixed framework, which rotatably supports a horizontal circular guide, means for rotating the guide, a mechanism for imposing vertical translations to the moveable framework, a mechanism suspended on the guide bearing the reel with the winding web, in which the circular guide has a hollow tubular section, and is rotatably held within a seat integral with moveable framework and including at least three pairs of wheels with mutually inclined axes for creating the seat for sliding and retaining the guide.

5 Claims, 7 Drawing Sheets

WINDING MACHINE FOR GROUPS OF PACKAGES

The present invention refers to machines adapted to wind regular groups of objects arranged on a pallet using an extensible web.

Regarding transport of groups of palletized objects, there are wound groups of objects by means of a web which is stretched during the winding with the aim of making each group appropriate, and stabilise the load of the pallet. The web is wound around the load of the pallet in a helical manner so as to cover the entire height of the load.

The number of turns of the winding depends on the height of the web, besides the height of the load. The machines adapted to wind the web are substantially of two types.

A first type of machine comprises a rotating platform on which the load to be wound is arranged, beside which there are arranged fixed means for supporting the reel of the stretchable web.

These means are provided with a vertical motion so that, due to the rotation of the load and the vertical movement of the reel, the web is wound helically on the load.

The machines of this type reveal the drawback lying in the fact that when the load of the pallet is made up of several layers of poorly stable objects, for example bottles, when rotated, the load tends to crumble under the action of the centrifuge force, and thus the machine may function solely at a relatively low speed of rotation of the load, to the detriment of the production capacity thereof.

A second type of known machines provides for that the load remains stationary, and that the reel be guided to cover a helical path around the load.

This type of machines comprises: a fixed base for supporting the load, a fixed framework overlying said base, a framework moveable vertically on the fixed framework, which rotatably supports a horizontal circular guide, means for rotating the guide, means for imposing vertical translations to the moveable framework, means rigidly suspended on said guide bearing the reel with the winding web.

The suspension means comprise a framework with vertical axis on which there is arranged the hub supporting the reel.

There are provided means which adjust the winding of the reel and confer the necessary tension to the web.

This type of machine has a winding speed limit given that the centrifuge force to which the means are subjected, rigidly suspended on said guide bearing the reel with the winding web, and the respective reel, complicates the action of maintaining the reel with the rigorously vertical axis, which is essential for a correct winding of the reel on the load.

The drawback derives from the torsional deformation to which the circular guide—to which there are rigidly suspended means bearing the reel with web—is locally subjected, forcing to reduce the maximum axial dimensions of the reel and consequently the weight of the framework which supports it.

Machines of this type suitable for using reels having an axial dimension greater than 750 mm, and rotate at more than 40 rpm are not currently known.

The axial dimension of the reel determines the number of windings for covering a load of a given height and thus conditions the production capacity of the machine, given that the time for winding a load depends on the number of revolutions per minute that the reel can perform and on the number of windings required to cover the load.

The object of the invention is to provide a winding machine of this type capable of allowing operating at a winding speed comparatively greater than that of the known machines, simultaneously operating with reels having an axial dimension comparatively greater than the axial dimension of the reels used currently.

This object is attained by a machine having the characteristics listed in the independent claim.

The dependent claims refer to subordinate characteristics adapted to confer further advantages to the invention.

The winding machine according to the invention comprises a circular guide with tubular section, i.e. a hollow and closed section.

The guide has preferably a circular section (for example internally so as externally), but it could be square, triangular or irregular-sectioned (for example, only internally).

The guide is rotatably held in a seat fixed to the moveable framework, which comprises at least three peripheral pairs of wheels, equally spaced on a circumference, which have the axes mutually inclined for creating the seat for sliding and retaining the guide.

In a preferred solution each pair of wheels may be replaced by a group of pairs of adjacent wheels, the groups being fixed to the moveable framework in an equally spaced position on a circumference.

In the case in which the horizontal guide has a circular section (externally), it comprises—on the outer side—two flat elements converging on the horizontal symmetry plane, which serve as a sliding track for the wheels which constitute the seat for sliding and retaining the guide.

At least one bracket removably supporting the means bearing the reel with web is rigidly fixed to the guide.

The brackets rigidly connected to the guide, should they be more than one, are equally spaced to allow simultaneously winding several webs on the load.

The at least one bracket comprises a vertical base to which there are fixed the detachable means which support the at least one reel with web to be wound in vertical position.

The construction and functional characteristics of the invention will be apparent from the detailed description that follows, with reference to the figures of the attached drawings illustrating a preferred embodiment provided by way of non limiting example.

Figure 1:
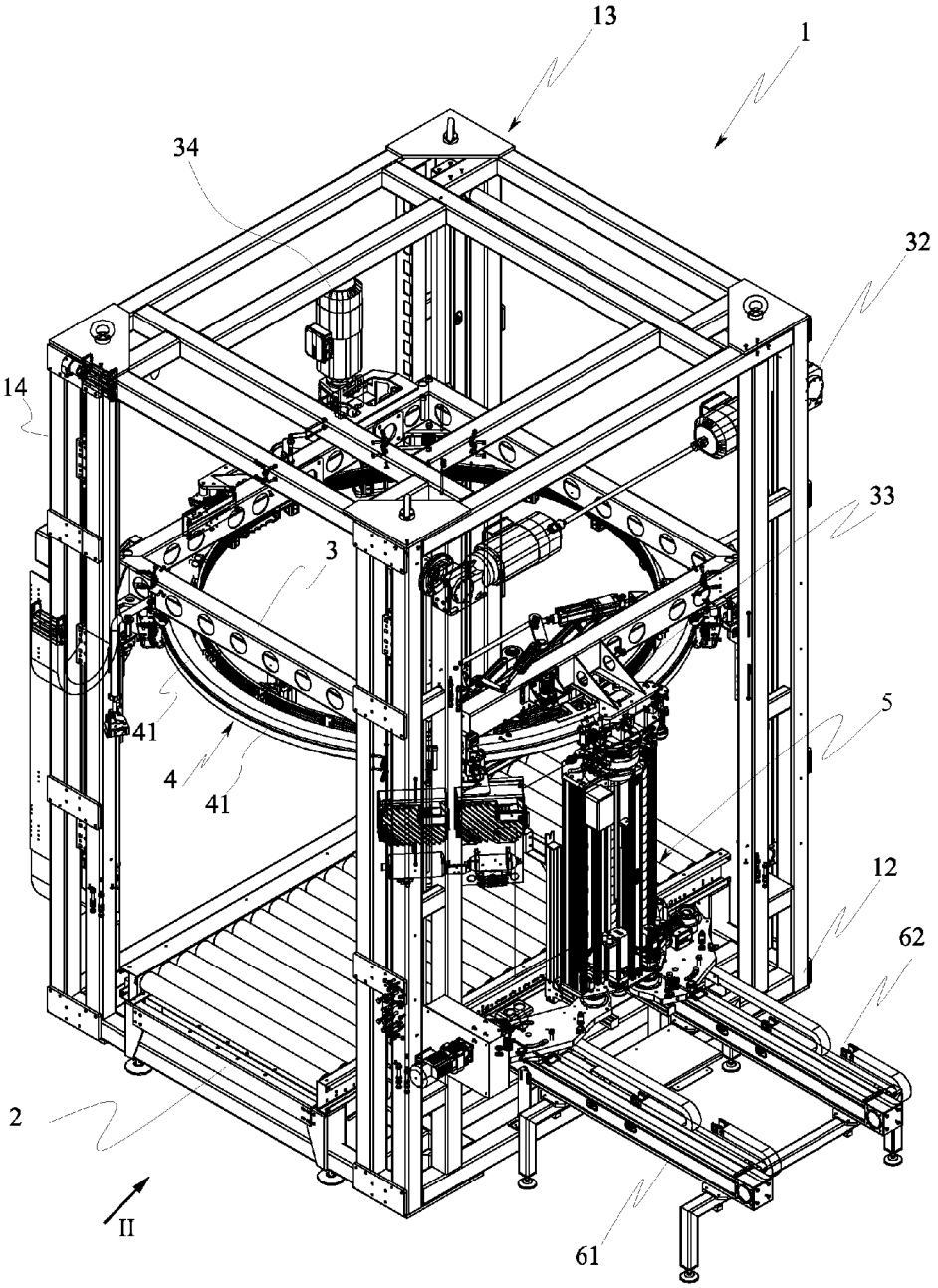
FIG. 1 shows a perspective view of the machine.

The figures show a bridge framework 1, with square-shaped base, which is traversed by a roller track 2 on which the load to be wound travels so to be arranged in a winding station at the centre of the framework 1.

Within the framework 1 the roller track constitutes the stationary platform of the load during the winding.

The framework 1 comprises four uprights respectively 11, 12, 13 and 14 which serve as a guide for a horizontal framework 3 which is suspended with four belts 31, arranged within the uprights, for moving vertically, upon the action of the motors 32.

Figure 3:
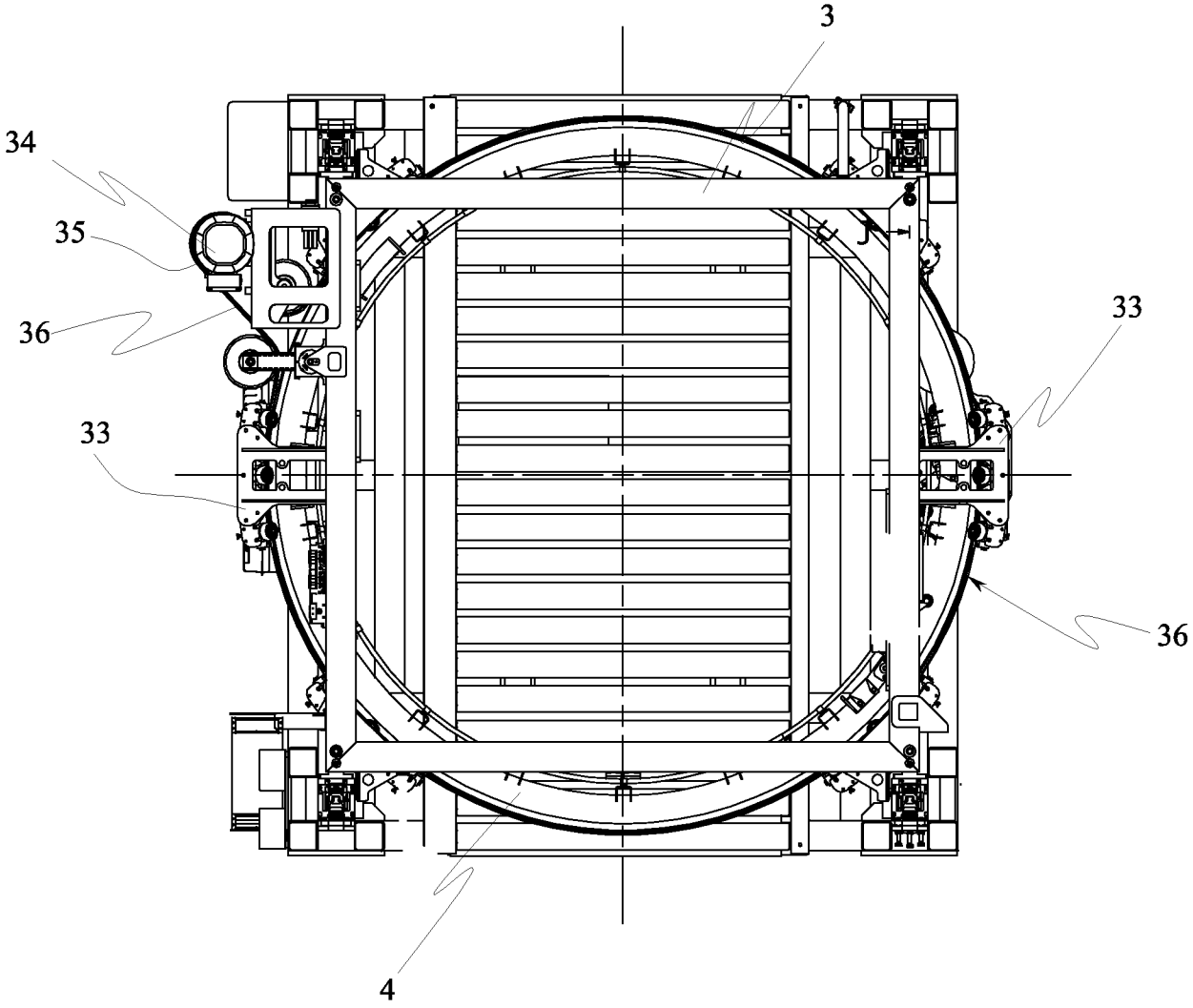
FIG. 3 shows the section III-III of FIG. 2.
Figure 4:
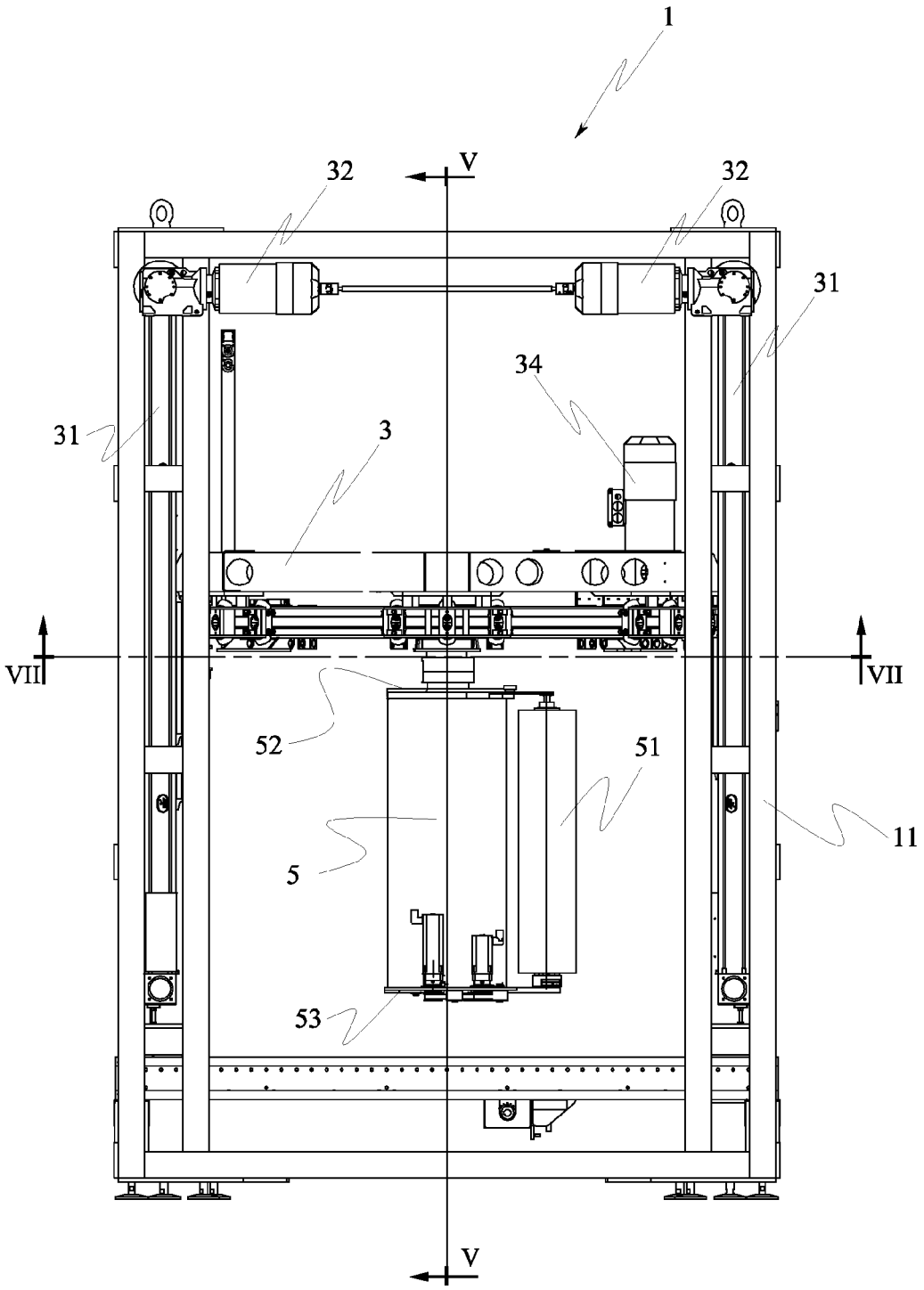
FIG. 4 shows the section IV-IV of FIG. 2.
Figure 7:
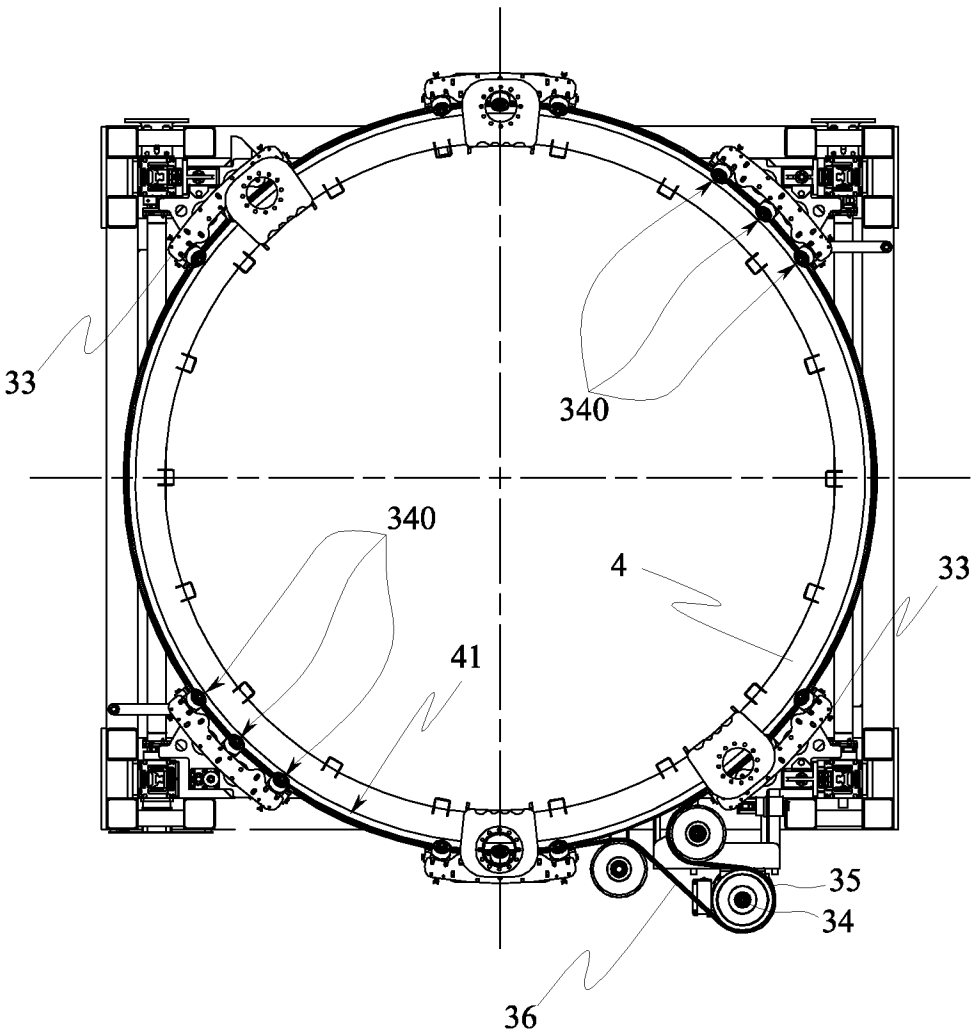
FIG. 7 shows the section VII-VII of FIG. 4.

The framework 3 supports by means of at least three brackets 33, preferably six only two of which are illustrated in FIG. 3, and six are illustrated in FIG. 7, a circular guide 4 with circular section, which is free to rotate (FIG. 3).

Each bracket 33 supports a body which comprises three pairs of idle wheels 340, having the inclined axes.

The guide 4 has two symmetric circular flat elements 41, which serve as rolling tracks for the wheels 340, between which the guide 4 is slidably supported.

Figure 2:
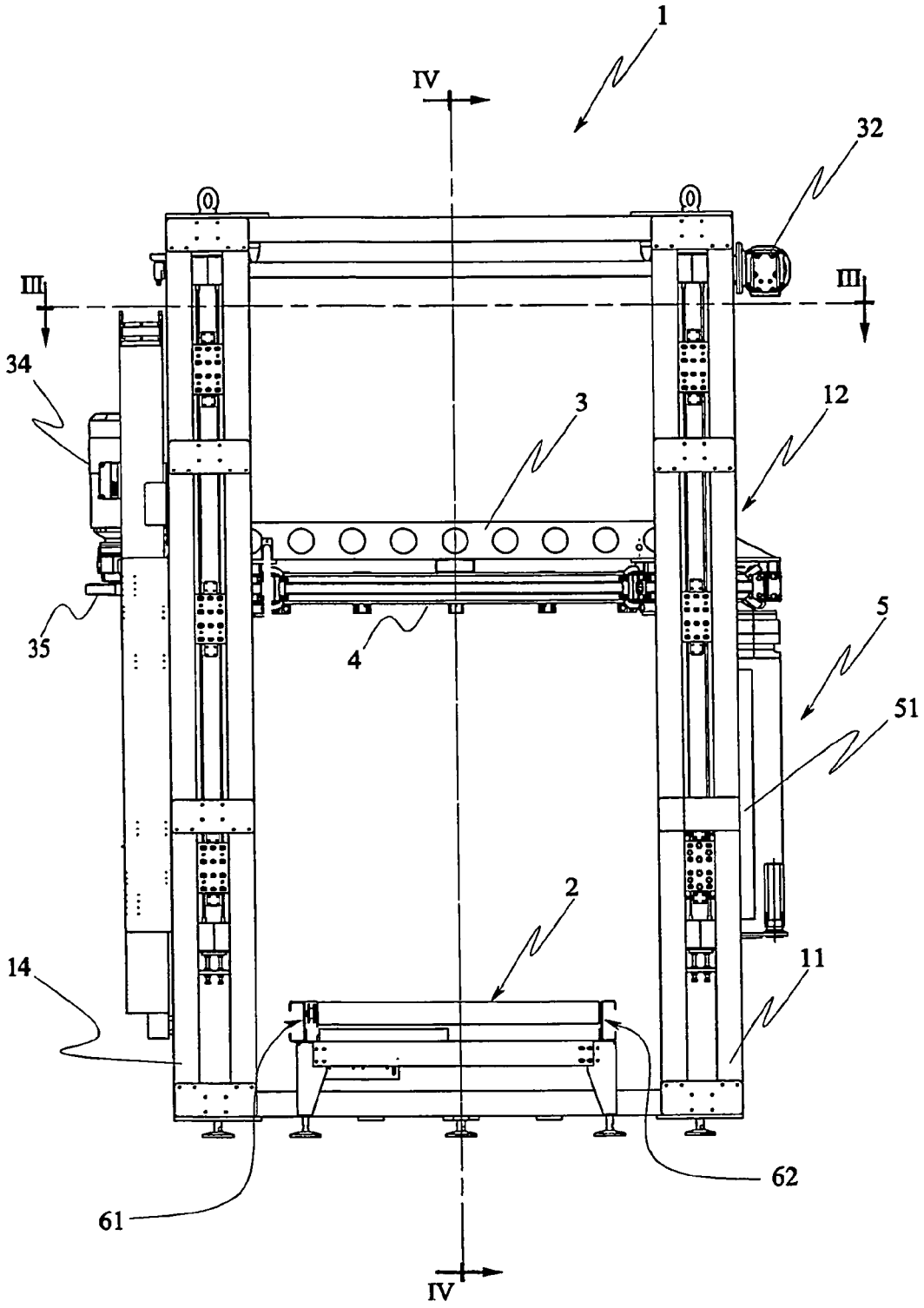
FIG. 2 shows a front view of the machine, from the direction II of FIG. 1.

The electric motor 34 which actuates a pulley 35 (FIGS. 2 and 3) on whose groove there is wound a belt 36 is fixed to the framework 3.

The belt 36 is closed loop-like to the guide 4 and it is wound between the flat elements of the same driving it in rotation.

Figure 5:
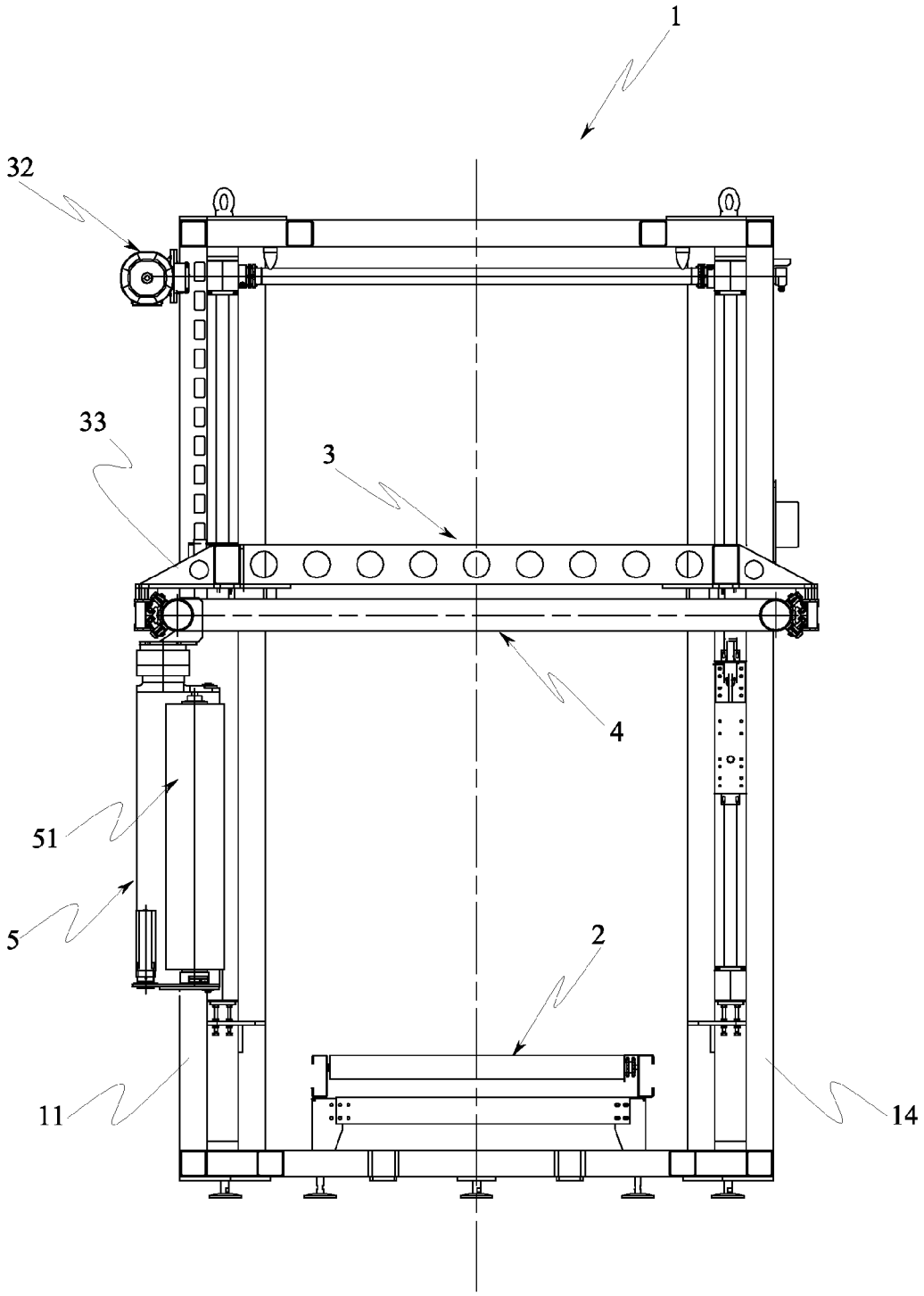
FIG. 5 shows the section V-V of FIG. 4.
Figure 6:
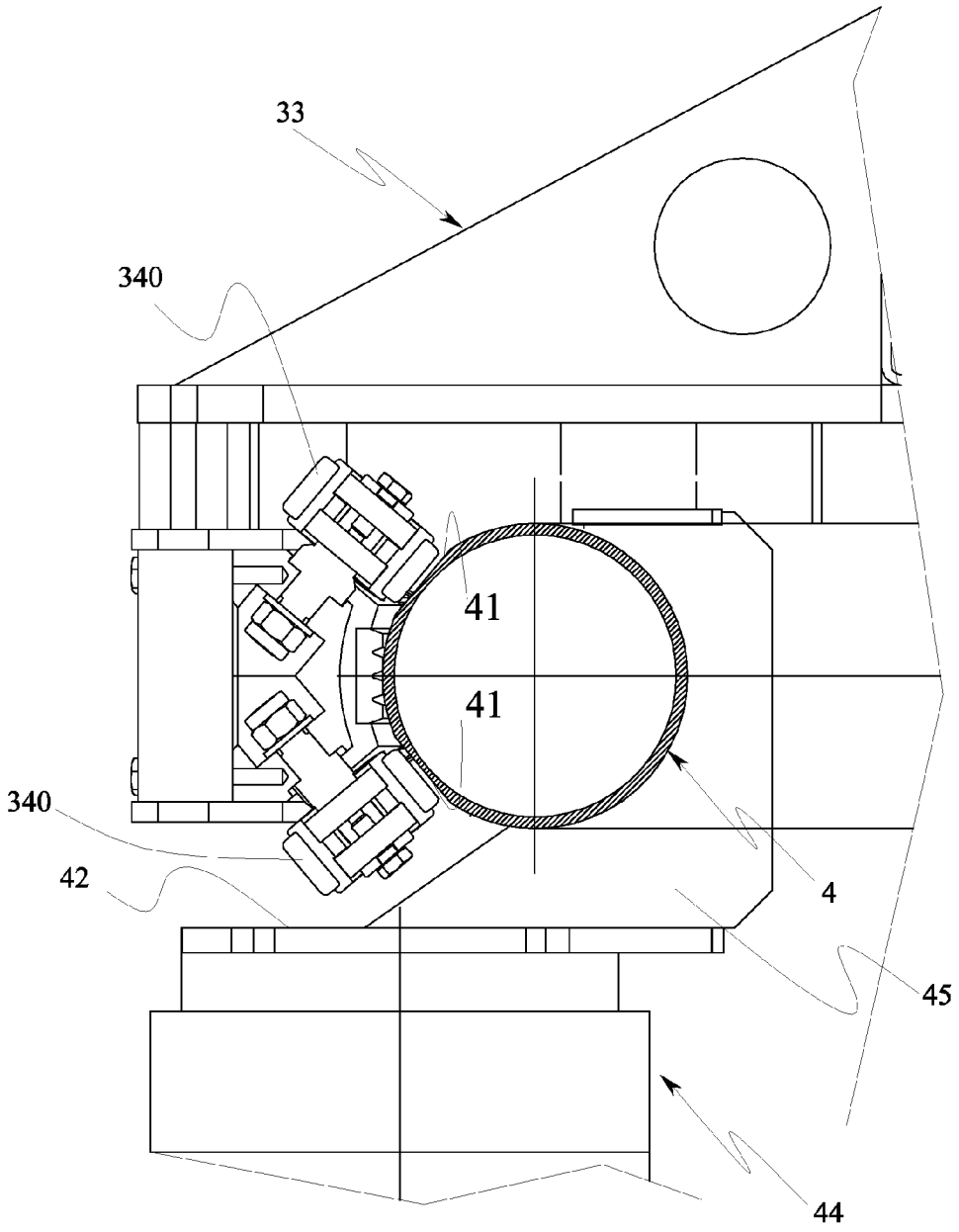
FIG. 6 shows an enlarged detail of FIG. 5.

The guide 4 has at least one lower bracket 42 (FIGS. 5 and 6) by means of the brackets 45, which carries a horizontal base 43 to which the means 44 for supporting the framework 5 which carries the reel 51 are removably fixed.

The framework 5 is of the known type and it is not described in detail.

The means 44 are also of the known type, and they are adapted to receive a vertical tang of the framework 5 for carrying the reel, blocking it by means of known means neither described in detail nor illustrated.

At the base of the framework 1, in one of the two sides parallel to the track 2, there are arranged two parallel horizontal guides 61 and 62, shown solely in FIG. 1, which extend in symmetric position with respect to a diametric plane of the guide 4.

On each of the guides 61 and 62 there may slide, supported by means not illustrated, a framework 5 for carrying the reels to be placed between a position distant from the guide 4 in which the frameworks 5 are collected with the finished reel 51, at a position beneath the guide 4 in which the frameworks are seized and blocked by the means 44.

The framework 5 for carrying the reel 51 is made up of an upper plate 52 and a lower plate 53 connected by spacers not illustrated, usual web tensioning means; the means on which the reel 51 is arranged are derived from the plates.

The motor 34 which rotates the guide 4 and the motors designated for the vertical translation thereof are controlled by a microprocessor, not illustrated, which actuates them synchronously so that they helically wind the reel on the load arranged on the roller tracks 2.

The circular section configuration of the guide 4 confers to the same a high torsional resistance which efficiently counters the moment generated by the centrifuge force, operating on the framework 5 and on the reel 51, preventing displacements thereof towards the external which would damage the correct tensioning in the web which is unwound from the reel 51.

The torsional deformations are further hindered by the action of the wheels 340 on the flat elements 41 of the guide.

The aforementioned characteristics allow operating with reels having an axial length of 1,000 mm, 30% greater than the usual one, and at a winding speed up to 70 rpm, almost twice the usual speed.

The invention shall be deemed not limited to the described example and it may be subjected to variants and improvements without departing from the scope of protection of the claims that follow.

The invention claimed is:

1. A machine for creating at least one helical winding of a web extensible around a load, comprising:

a stationary base for supporting the load, a fixed framework overlying said base, a moveable framework overlying the load vertically on the fixed framework, a horizontal circular guide rotatably supported by the moveable framework, a first motor for rotating said horizontal circular guide with respect to said moveable framework, a second motor for imposing vertical translations to the moveable framework, a reel-carrying framework rigidly suspended on said guide bearing a reel carrying the web, wherein the circular guide has a tubular section, and the circular guide is slidable within a seat integral to the moveable framework constituted by at least three groups for sliding and supporting the guide, placed circumferentially equally spaced along the moveable framework and each provided with at least one pair of wheels with mutually inclined axes which create the seat for sliding and retaining the guide, wherein the guide has a hollow cross section with respect to a vertical sectional plane, the hollow cross section having an outer circular shape, and the guide comprising two flat elements converging on a horizontal median plane of the guide which serve as a sliding seat for the pairs of wheels, said two flat elements being disposed in symmetric positions with respect to the horizontal median plane of the guide.

2. The machine according to claim 1, wherein each group for sliding and supporting the guide constituting the seat of the guide comprises at least two pairs of wheels with mutually inclined axes which create the seat for sliding and retaining the guide.

3. The machine according to claim 1, wherein the first motor is constituted by an electric motor having an axis along which is arranged a pulley having a groove on which there is wound a flexible means which is also wound on the periphery of the guide between the pairs of wheels with mutually inclined axes.

4. The machine according to claim 1, wherein each group for sliding and supporting the guide is arranged on a bracket integral to the moveable framework.

5. The machine according to claim 4, further comprising six brackets each provided with three pairs of wheels.

* * * * *